US008188398B2

(12) United States Patent
Chu

(10) Patent No.: US 8,188,398 B2
(45) Date of Patent: May 29, 2012

(54) PRESS SWITCH

(76) Inventor: Ching-Hsiung Chu, Taipei (TW)

( * ) Notice: Subject to any disclaimer, the term of this patent is extended or adjusted under 35 U.S.C. 154(b) by 172 days.

(21) Appl. No.: 12/821,152

(22) Filed: Jun. 23, 2010

(65) Prior Publication Data

US 2011/0315533 A1 Dec. 29, 2011

(51) Int. Cl.
*H01H 13/02* (2006.01)
*H01H 9/16* (2006.01)

(52) U.S. Cl. ..... 200/345; 200/312; 200/520

(58) Field of Classification Search ..... 200/310–316, 200/520, 341, 345, 566
See application file for complete search history.

(56) References Cited

U.S. PATENT DOCUMENTS

| | | | | |
|---|---|---|---|---|
| 4,496,813 | A * | 1/1985 | Fukushima | 200/314 |
| 6,310,308 | B1 * | 10/2001 | Watson et al. | 200/520 |
| 6,667,451 | B1 * | 12/2003 | Hart | 200/314 |
| 6,770,829 | B1 * | 8/2004 | Hart | 200/314 |
| 7,804,037 | B2 * | 9/2010 | Cove | 200/520 |
| 8,129,640 | B2 * | 3/2012 | Liao | 200/314 |
| 2005/0263380 | A1 * | 12/2005 | Bouvier et al. | 200/310 |

* cited by examiner

*Primary Examiner* — Briggitte R Hammond

(57) ABSTRACT

A press switch is composed of a base, a light-emitting device, a housing, a movable seat, and a pressing element. Due to the flat surfaces of the base and the ribs of the movable seat, the area of contact between the base and the movable seat is reduced. In addition, due to the ribs of the movable seat and the flat surfaces of the housing, the area of contact between the movable seat and the housing is also reduced. These reduced areas of contact allow the pressing element to be pressed stably and smoothly.

7 Claims, 8 Drawing Sheets

PRESS SWITCH

BACKGROUND OF THE INVENTION

1. Technical Field

The present invention relates to a press switch and, more particularly, to a switch structure that can be pressed with enhanced stability.

2. Description of Related Art

Referring to FIG. 1, a conventional press switch 1 is composed mainly of a base 11, a housing 12, a movable seat 13, and a pressing element 14. To actuate the press switch 1, the pressing element 14 is pressed to drive the movable seat 13 downward such that the internal terminals contact with each other to form electrical connection. Thus, an apparatus controlled by the press switch 1 is turned on and off by pressing and releasing the pressing element 14, respectively. However, as each fixing portion 121 of the housing 12 that is designed to connect the housing 12 and the base 11 has an elongated shape and is engaged with the base 11 only via an engaging block 111, the housing 12 of the press switch 1 tends to get loose or fall apart after long-term use. Moreover, the friction at the flat contact surfaces between the movable seat 13 and the housing 12 tends to build up after the press switch 1 is used for a while, and consequently the movable seat 13 cannot be pushed downward as stably and smoothly as before or is even displaced, thereby reducing the stability and service life of the press switch 1.

BRIEF SUMMARY OF THE INVENTION

The first object of the present invention is to provide a press switch composed essentially of a base, a light-emitting device, a housing, a movable seat, and a pressing element, wherein the line-to-surface contact between the ribs of the movable seat and the flat surfaces of the base and between the ribs of the movable seat and the flat surfaces of the housing results in a minimized area of contact, and hence reduced friction, between the movable seat and the base and between the movable seat and the housing, thereby enhancing the stability and smoothness of motion of the pressing element when pressed.

The second object of the present invention is to provide the foregoing press switch, wherein the housing has T-shaped fixing portions configured for engaging with corresponding engaging blocks on the base and thereby connecting the housing and the base. Thus, the housing is securely connected to the base and prevented from getting loose.

The third object of the present invention is to provide the foregoing press switch, wherein a conductive element is provided on one side of the movable seat and includes a plurality of resilient members that function as a plurality of contacts. Therefore, not only can a reliable electrical connection be formed, but also the electrical connection is achievable even if some of the resilient members suffer from elastic fatigue or are damaged.

BRIEF DESCRIPTION OF THE SEVERAL VIEWS OF THE DRAWINGS

The invention as well as a preferred mode of use, further objects, and advantages thereof will be best understood by referring to the following detailed description of an illustrative embodiment in conjunction with the accompanying drawings, in which.

DETAILED DESCRIPTION OF THE INVENTION

Figure 1:
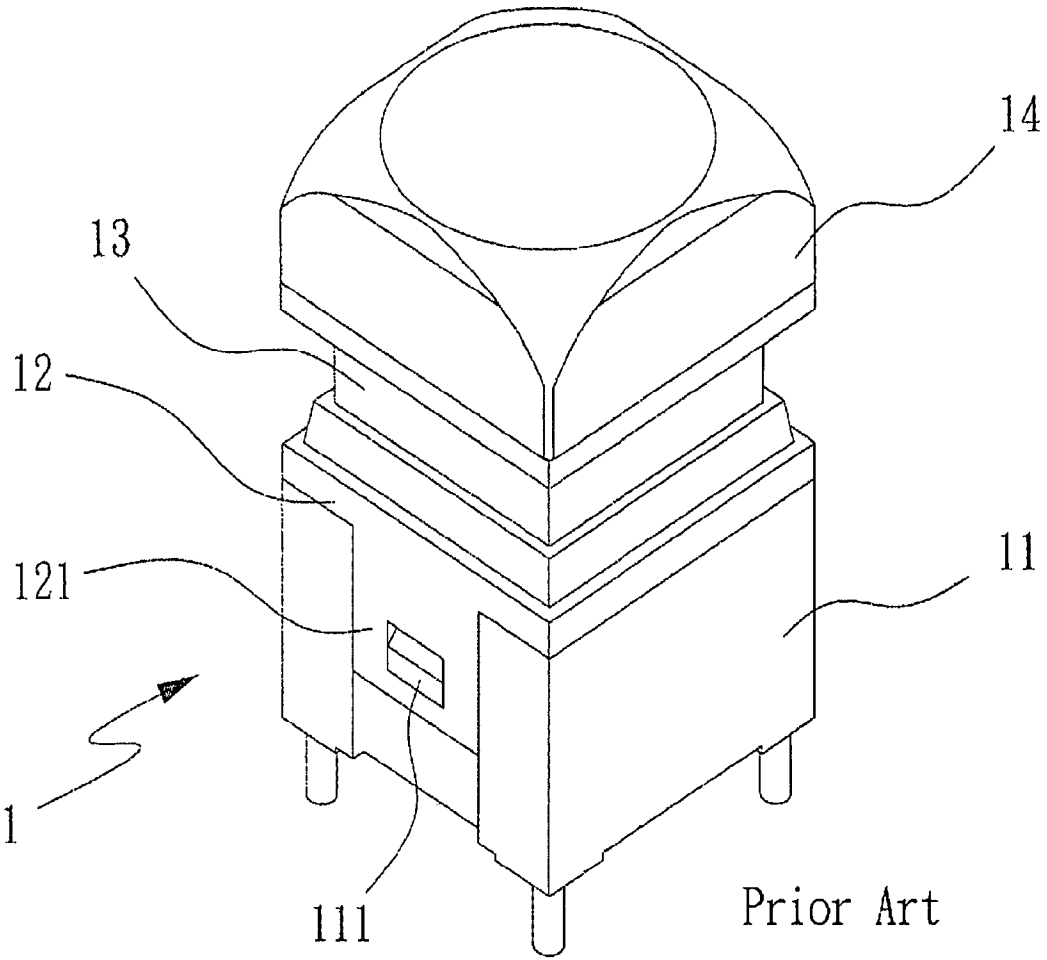
Prior Art FIG. 1
FIG. 1 is a perspective view of a conventional press switch.
Figure 2:
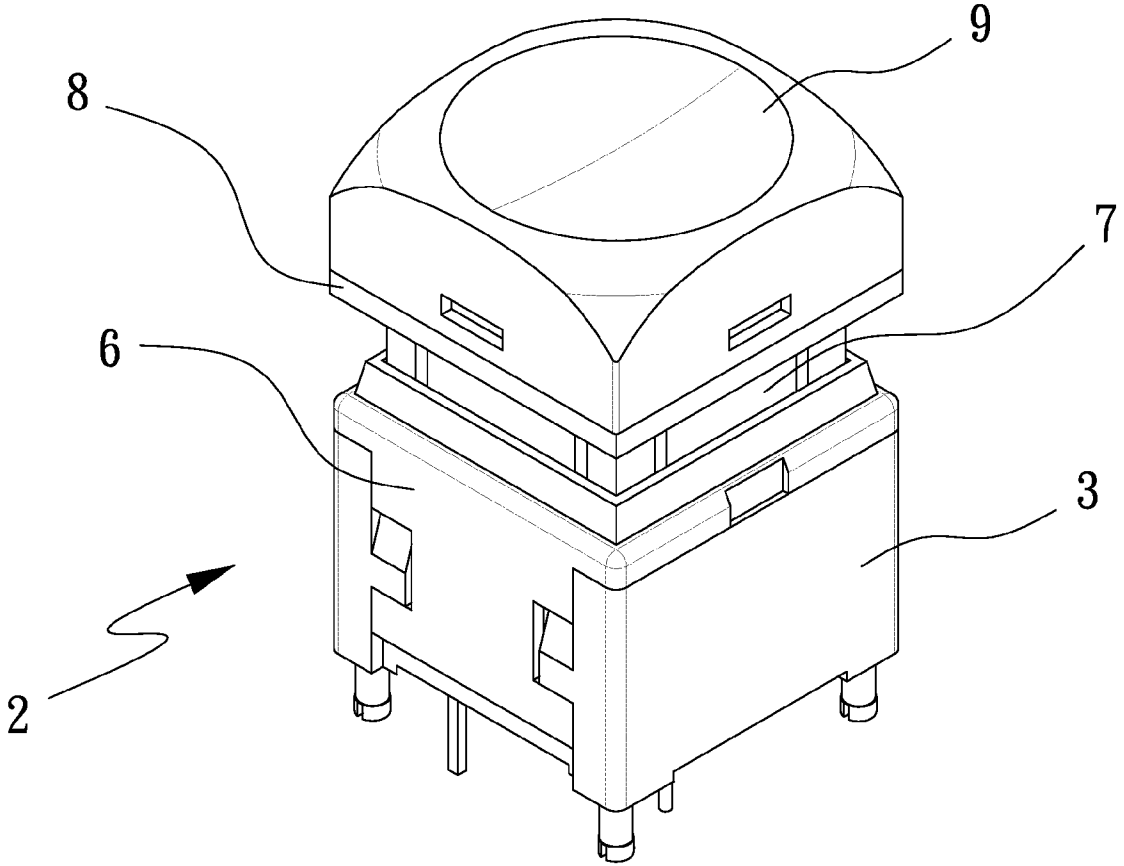
FIG. 2 is an assembled perspective view of a press switch according to the present invention.
Figure 3:
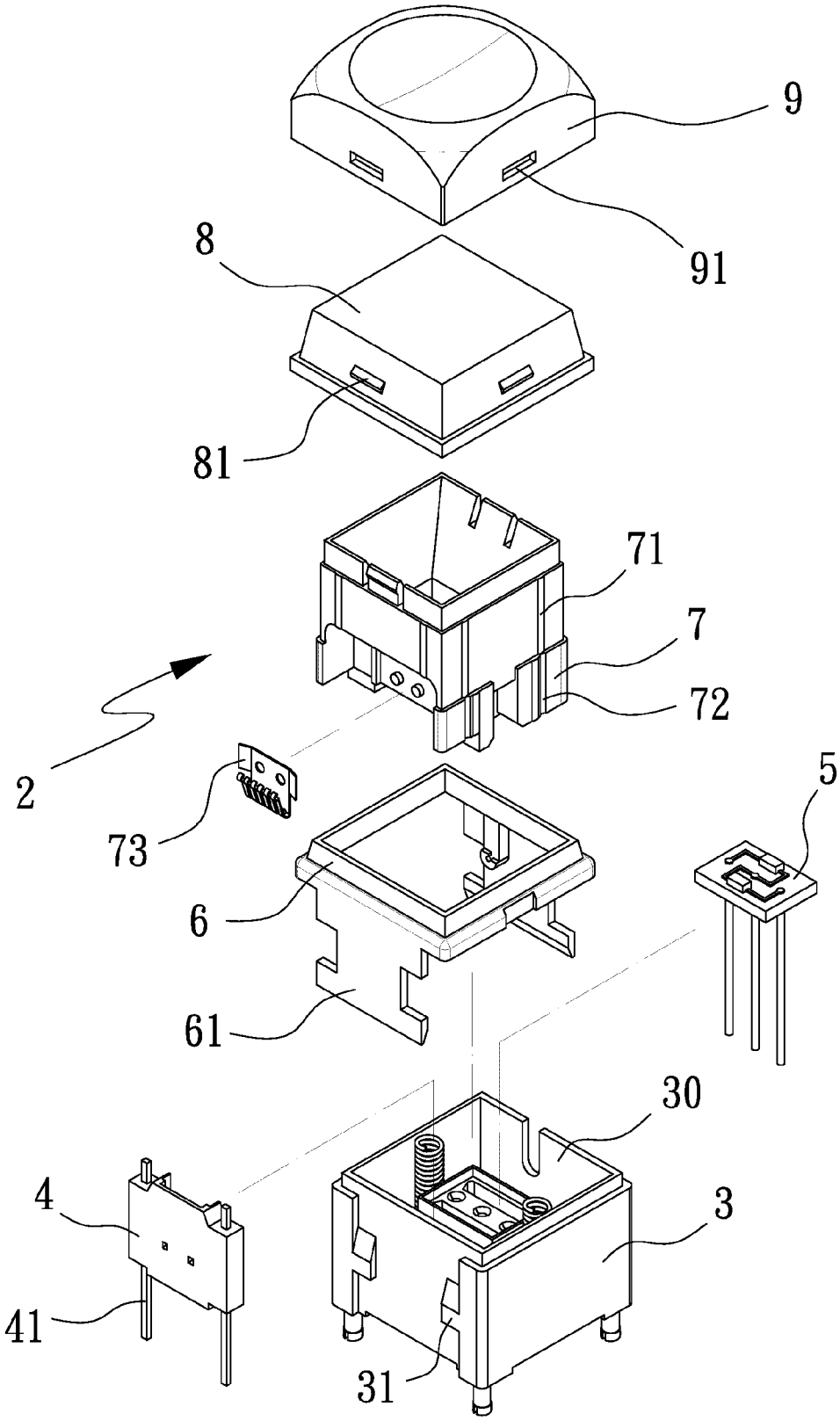
FIG. 3 is an exploded perspective view of the press switch according to the present invention.
Figure 4:
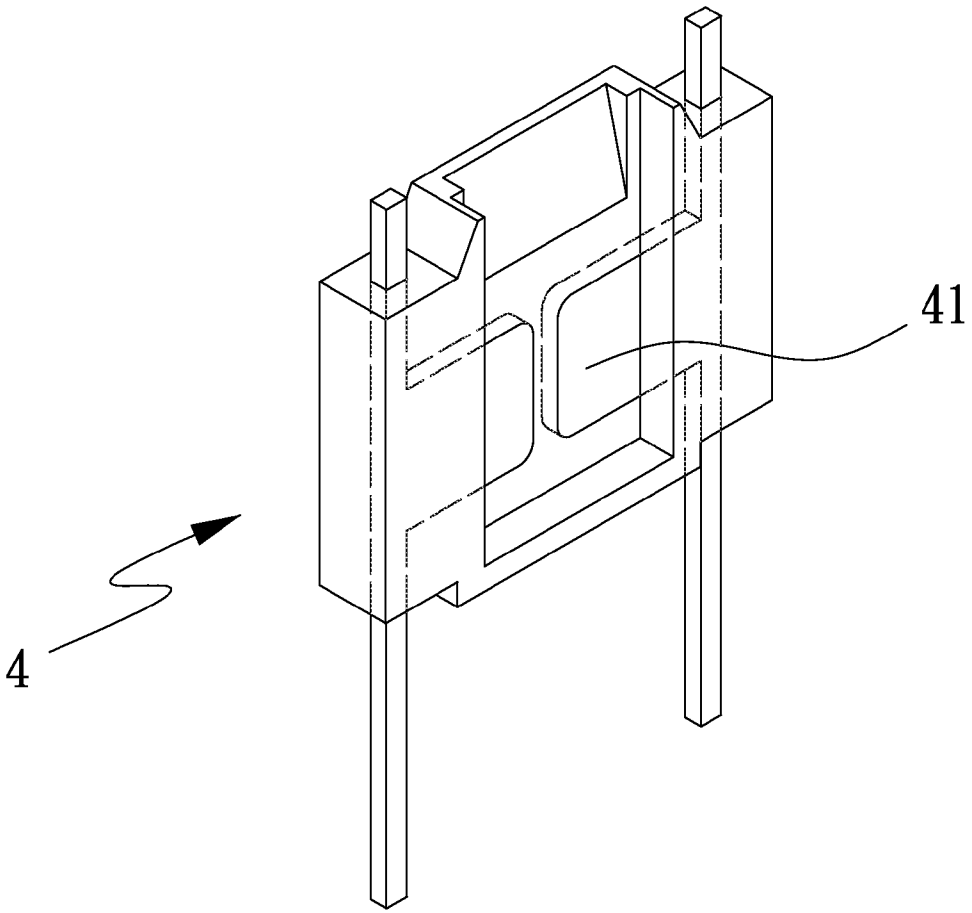
FIG. 4 is a perspective view of a terminal plate in the present invention.
Figure 5:
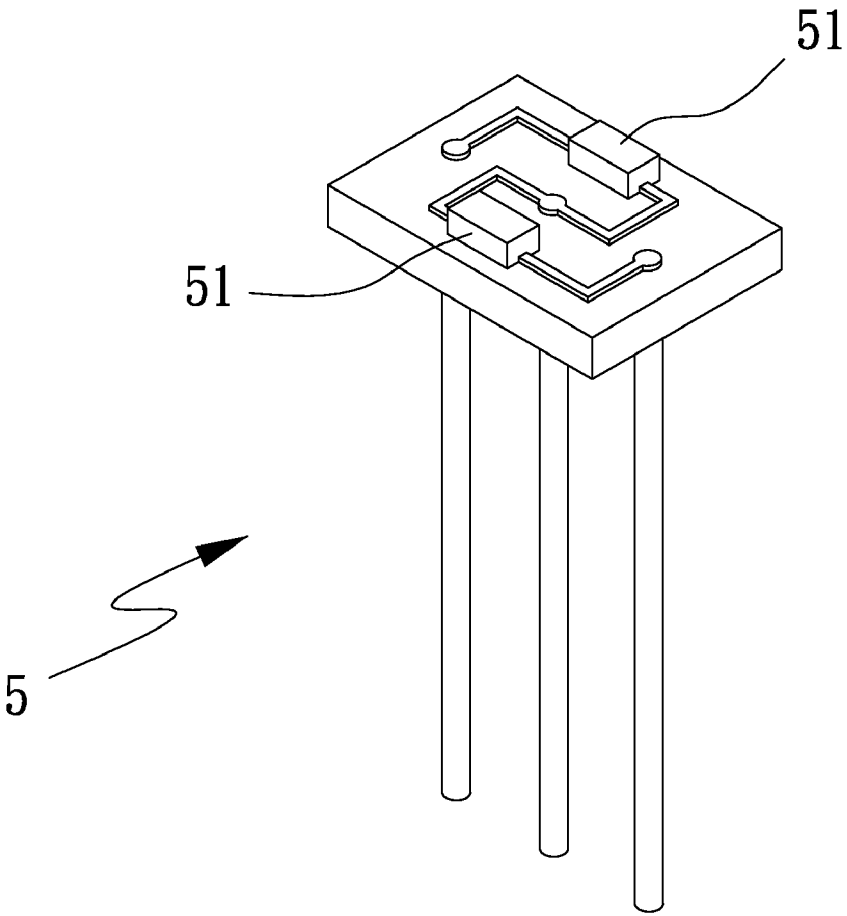
FIG. 5 is a perspective view of a light-emitting device in the present invention.
Figure 6:
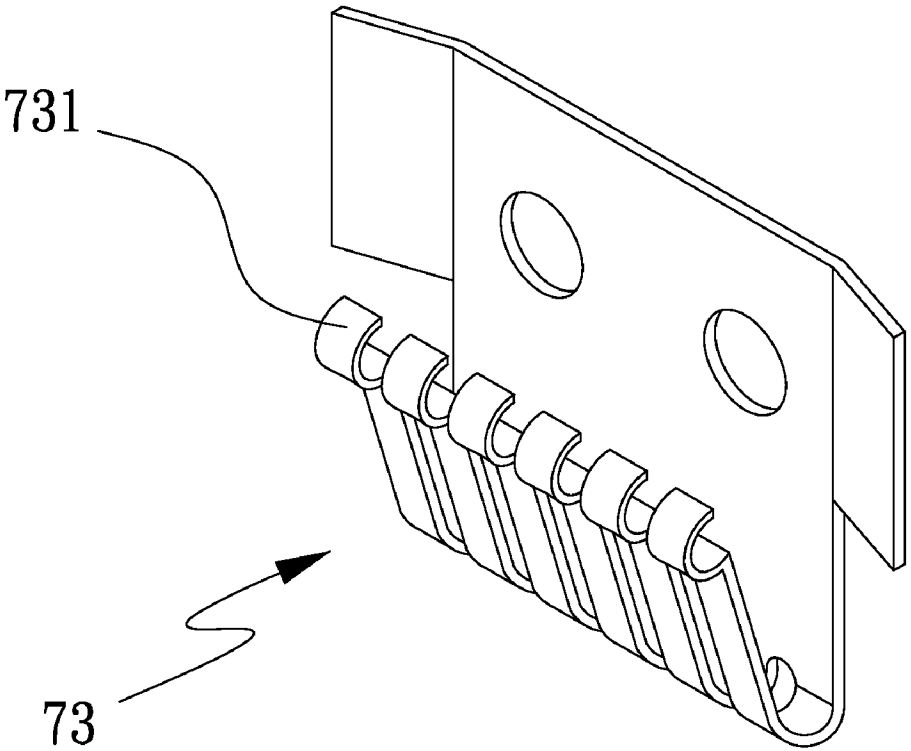
FIG. 6 is a perspective view of a conductive element in the present invention.
Figure 7:
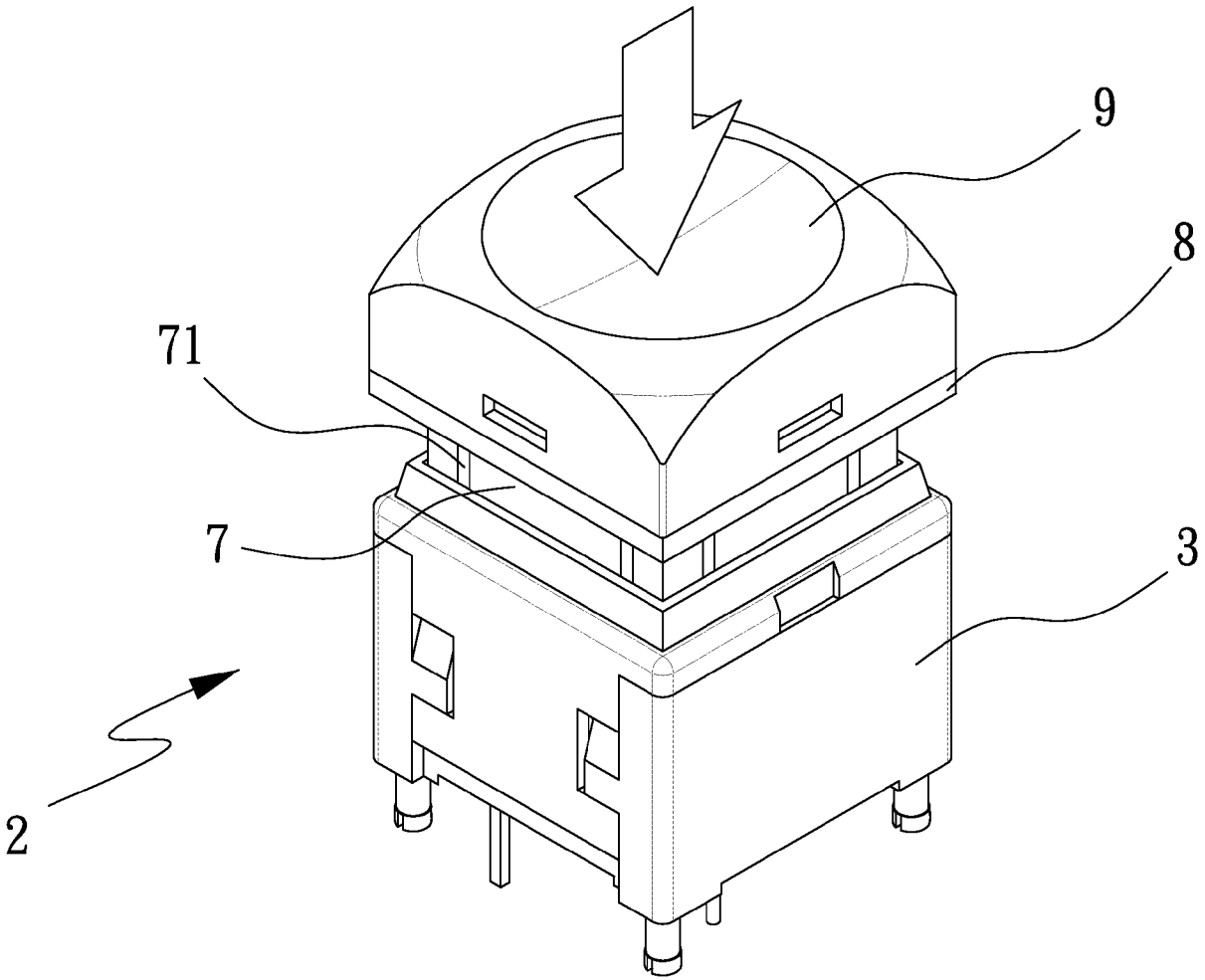
FIG. 7 and FIG. 8 show operation of the press switch according to the present invention.
Figure 8:
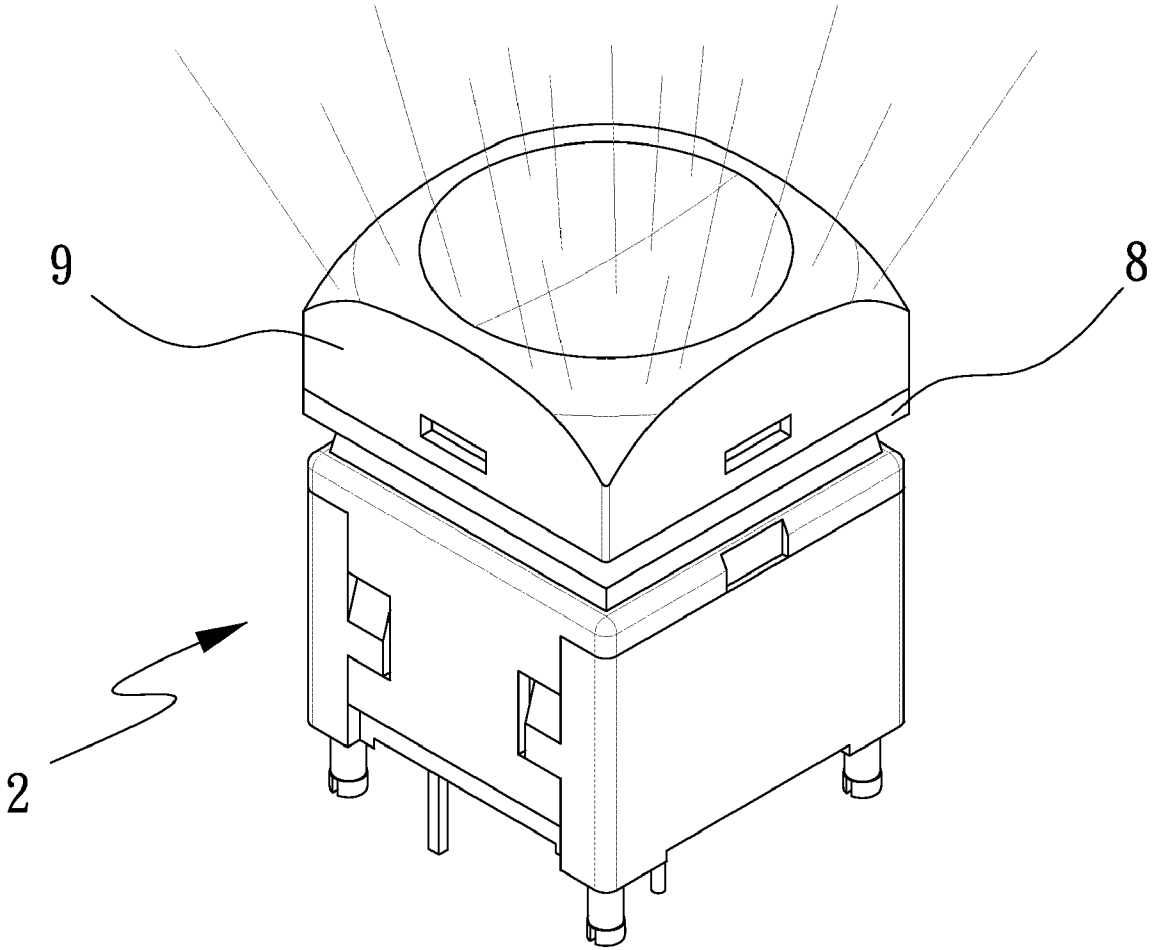

FIG. 2 through FIG. 8 show an assembled perspective view, an exploded perspective view, three perspective partial views, and two operational views of the present invention, respectively. As shown in the drawings, a press switch 2 essentially includes a base 3, a light-emitting device 5, a housing 6, a movable seat 7, and a pressing element 8.

The base 3 defines a receiving space 30 therein and has two corresponding sides each externally provided with two corresponding engaging blocks 31. A terminal plate 4 is disposed in the receiving space 30 and provided with at least two conductive terminals 41.

The light-emitting device 5 is disposed in the receiving space 30 of the base 3 and provided with at least two light-emitting diodes (LEDs) 51.

The housing 6 has two corresponding sides each extended with a T-shaped fixing portion 61. The housing 6 is engaged with the base 3 via the fixing portions 61.

The movable seat 7 is inserted in the base 3 and has four outer surfaces each provided with at least two ribs 71 and at least two grooves 72. A conductive element 73 is disposed on one side of the movable seat 7 and provided with a plurality of resilient members 731.

The pressing element 8 is made of a light-permeable material and covers the movable seat 7. In addition, the pressing element 8 has four outer surfaces each provided with a protruding block 81. A transparent cover 9 is disposed on the pressing element 8 and has four outer surfaces each formed with a slot 91. The transparent cover 9 is connected to and thereby covers the pressing element 8 via the slots 91.

The terminal plate 4 and the light-emitting device 5 are disposed in the receiving space 30 of the base 3 such that the pins of the conductive terminals 41 of the terminal plate 4 and the pins of the light-emitting device 5 pass through the bottom of the base 3 to connect with external wires. The conductive element 73 on one side of the movable seat 7 is configured to make electrical contact with the conductive terminals 41 of the terminal plate 4.

To actuate the press switch 2, the pressing element 8 is pressed to drive the movable seat 7 downward. Consequently, the conductive element 73 on one side of the movable seat 7 contacts with the conductive terminals 41 of the terminal plate 4 to form a closed circuit and thereby turn on the apparatus controlled by the press switch 2. Meanwhile, the LEDs 51 of the light-emitting device 5 are turned on via a user circuit to emit light. The light emitted by the LEDs 51 projects on and passes through the pressing element 8 and the transparent cover 9, making the entire pressing element 8 glow. When the pressing element 8 is subsequently released, thus moving the conductive element 73 away from the terminal plate 4, the closed circuit previously formed is opened. Furthermore, a reduced area of contact between the base 3 and the movable seat 7 is achieved by flat surfaces of the base 3 and the ribs 71 of the movable seat 7, as the ribs 71 on the outer surfaces of the movable seat 7 and the four flat inner surfaces of the housing 6 make line-to-surface contact, the area of contact is minimized to reduce friction. Therefore, when the pressing element 8 is pressed, the stability and smoothness of motion of the pressing element 8 is enhanced. Besides, as the fixing portions 61 extending from the two corresponding sides of the housing 6 have a T-shaped configuration and are each engaged with two corresponding engaging blocks 31 on the base 3, the housing 6 is securely coupled to the base 3 and unlikely to get loose or fall off when pulled.

As another feature of the press switch 2 of the present invention, the electrical connection between the conductive element 73 on one side of the movable seat 7 and the conductive terminals 41 of the terminal plate 4 is formed through the plural resilient members 731 of the conductive element 73. The plural resilient members 731 not only provide a reliable electrical connection but also ensure that, should some of the resilient members 731 suffer from elastic fatigue or be damaged, the intended electrical connection can still be carried out by the remaining resilient members 731. Moreover, as the connection between the transparent cover 9 and the pressing element 8 is accomplished by engagement between the protruding blocks 81 of the pressing element 8 and the slots 91 of the transparent cover 9, and the protruding blocks 81 and the slots 91 are provided on all four sides of the pressing element 8 and the transparent cover 9, respectively, the transparent cover 9 can be connected to the pressing element 8 in an arbitrary direction. In particular, when printed with a pattern such as numbers, words, and symbols, the transparent cover 9 can be mounted on the pressing element 8 in the desired direction.

What is claimed is:

1. A press switch, essentially comprising:

a base defining a receiving space therein and having two corresponding sides each externally provided with two engaging blocks;

a light-emitting device disposed in the receiving space of the base and provided with at least two light-emitting diodes (LEDs);

a housing having two corresponding sides each extended with a T-shaped fixing portion, wherein the housing is engaged with the base via the fixing portions;

a movable seat inserted in the base and having four outer surfaces each provided with at least two ribs and at least two grooves; and a pressing element covering the movable seat;

wherein a reduced area of contact between the base and the movable seat is achieved by flat surfaces of the base and the ribs of the movable seat, and a reduced area of contact between the movable seat and the housing is achieved by the ribs of the movable seat and flat surfaces of the housing, thus allowing the pressing element to be pressed stably and smoothly; and wherein the T-shaped fixing portions of the housing allow the housing to be stably connected to the base and prevent the housing from getting loose.

2. The press switch of claim 1, wherein a terminal plate is disposed in the receiving space of the base and provided with at least two conductive terminals.

3. The press switch of claim 1, wherein the movable seat has a side provided with a conductive element.

4. The press switch of claim 3, wherein the conductive element is provided with a plurality of resilient members.

5. The press switch of claim 1, wherein the pressing element has four outer surfaces each provided with a protruding block.

6. The press switch of claim 1, wherein the pressing element is made of a light-permeable material.

7. The press switch of claim 1, wherein a transparent cover is provided on the pressing element and has four outer surfaces each formed with a slot.

* * * * *